US011517829B2

(12) United States Patent
Rey

(10) Patent No.: US 11,517,829 B2
(45) Date of Patent: Dec. 6, 2022

(54) GAMING ASSEMBLY AND METHODS OF USE THEREOF

(71) Applicant: Roberto Parker Rey, Marietta, GA (US)

(72) Inventor: Roberto Parker Rey, Marietta, GA (US)

(73) Assignee: Roberto Parker Rey, Marietta, GA (US)

( * ) Notice: Subject to any disclaimer, the term of this patent is extended or adjusted under 35 U.S.C. 154(b) by 409 days.

(21) Appl. No.: 16/738,065

(22) Filed: Jan. 9, 2020

(65) Prior Publication Data

US 2020/0215445 A1 Jul. 9, 2020

Related U.S. Application Data

(60) Provisional application No. 62/790,401, filed on Jan. 9, 2019.

(51) Int. Cl.
*A63G 33/00* (2006.01)

(52) U.S. Cl.
CPC ..... *A63G 33/00* (2013.01)

(58) Field of Classification Search
CPC ..... A63G 33/00; A63B 71/02; A63B 71/03; A63B 71/04
See application file for complete search history.

(56) References Cited

U.S. PATENT DOCUMENTS 3,255,115 A * 6/1966 Peterson ..... A63B 69/0028 482/148
4,420,158 A * 12/1983 Klock ..... A63B 63/004 248/156
4,927,161 A * 5/1990 Brenneman ..... A63B 67/06 473/588
5,048,844 A * 9/1991 Haseltine ..... A63B 63/004 273/400
5,205,748 A * 4/1993 Petersheim ..... A63B 9/00 434/258
5,346,228 A * 9/1994 Offutt ..... A63B 63/00 473/477
6,053,824 A * 4/2000 Boudreaux ..... A63B 69/0028 473/440
6,200,234 B1 * 3/2001 Hannon ..... A63B 67/002 473/410
6,287,220 B1 * 9/2001 Caruso ..... A63B 69/0097 473/415
10,561,924 B1 * 2/2020 Jackson ..... H04W 4/38
10,702,785 B1 * 7/2020 Chen ..... A63B 71/03

(Continued)

*Primary Examiner* — Raleigh W Chiu
(74) *Attorney, Agent, or Firm* — Gertrud U. Rey

(57) ABSTRACT

Provided herein is a gaming assembly having two or more collapsible frames, two or more facings, and one or more means for attachment. Each of the frames may be composed of first and second upright frame members that are connected by one or more crossbar frame members to define a vertical plane. Each of the two or more facings is configured to fasten to the upright frame members and the crossbar frame members, covering the vertical plane. The facings feature one or more means for capturing the one or more means for attachment, such as by means of magnetic strips. The means for attachment may be made of a material such as rope with pieces of magnetic metal attached at each end, and is used to connect a first frame to a second frame.

6 Claims, 10 Drawing Sheets

(56) References Cited

U.S. PATENT DOCUMENTS

| | | | | |
|---|---|---|---|---|
| 2006/0046234 | A1* | 3/2006 | Sperry | A63B 69/00 482/148 |
| 2011/0092321 | A1* | 4/2011 | Szaro | A63B 63/004 473/478 |
| 2014/0024481 | A1* | 1/2014 | Adema | A63B 69/002 264/255 |
| 2017/0080312 | A1* | 3/2017 | Dickerson | A63B 63/004 |
| 2021/0362020 | A1* | 11/2021 | Grothe | A63B 63/004 |

* cited by examiner

GAMING ASSEMBLY AND METHODS OF USE THEREOF

CROSS-REFERENCE TO RELATED APPLICATIONS

This application claims the benefit of U.S. Provisional Application No. 62/790,401, filed Jan. 9, 2019. The entire contents of the above-identified application are hereby fully incorporated herein by reference.

TECHNICAL FIELD

The subject matter disclosed herein is generally directed to a method and apparatus for playing a competitive field game.

BACKGROUND

Athletically oriented games have become a popular means of leisure time activity for many people. The popularity of individual games can be attributed to the game having an appropriate mixture of skill, athletic ability, flexibility, a fostering of the competitive spirit, and having a set of rules and objectives which make the game easy and fun to play without requiring a large investment on the part of a player. Another factor which facilitates the popularity of a particular game is the ease of the game setup and its adaptability to being played in the physical space available to the players, as well as the portability of the necessary equipment required to play the game.

Athletic action games such as football, soccer, baseball, and basketball generally require a large playing area and multiple players on each team. Applicant is unaware of an action game as described herein, which is readily adaptable for either indoor or outdoor play and which is scalable as a factor of the available playing area and number of players.

SUMMARY

In one aspect, provided herein is a gaming assembly having two or more frames, two or more facings, and one or more means for attachment. Each of the two or more frames may be composed of a first upright frame member and a second upright frame member that are connected by one or more crossbar frame members. Each of the first and second upright frame members may have an L shape, a triangular shape, a square shape, or a rectangular shape. In specific embodiments, each of the first and second upright frame members has an L shape.

The first and second upright frame members may each have an upper end, a lower end, and an angled crook. A first crossbar frame member may connect the upper end of the first upright frame member to the upper end of the second upright frame member, a second crossbar frame member may connect the angled crook of the first upright frame member to the angled crook of the second upright frame member, and a third crossbar frame member may connect the lower end of the first upright frame member to the lower end of the second upright frame member. When the frame is assembled, the first crossbar frame member, the second crossbar frame member, and the first and second upright frame members define a vertical plane. In some embodiments, the vertical plane defines a square shape. In a preferred embodiment, the vertical plane defines a rectangular shape.

The first and second upright frame members may each be composed of two or more parts that are connected to each other by an interlocking mechanism. Similarly, each of the crossbar frame members may be connected to the upright frame members by an interlocking mechanism.

Each of the two or more facings may have a square shape or a rectangular shape that is configured to fasten to the upright frame members and the crossbar frame members, covering the vertical plane. In some embodiments, the facing may fasten to the upright frame members and crossbar frame members by means of releasable fasteners, such as, but not necessarily limited to, hook and loop attachments, slide fasteners, buttons, press buttons, magnets, hooks, thread, or a combination of these. In alternative embodiments, the facing fastens to the upright frame members and the crossbar frame members by means of a permanent fastening mechanism, such as, but not necessarily limited to, heat welding, glue, thread, staples, tape, or a combination thereof.

In some embodiments, the facings comprise the shape of a cross-shaped dodecagon, having a top flap, a bottom flap, and two side flaps. As such, the top flap, the bottom flap, and the two side flaps may be configured to fasten around the first crossbar frame member, the second crossbar frame member, and the first and second upright frame members, respectively.

The facings may further feature one or more means for capturing the one or more means for attachment. In some embodiments, the facings each comprise two or more, three or more, four or more, five or more, six or more, seven or more, eight or more, nine or more means for capturing the one or more means for attachment. In specific embodiments, the facings each comprise nine means for capturing the one or more means for attachment. The means for capturing the one or more means for attachment may include, but are not necessarily limited to, hook and loop attachments, magnetic strips, adhesive tape, or a combination thereof. In a preferred embodiment, the means for capturing the one or more means for attachments are magnetic strips.

Preferably, the facings are foldable. They may be made from materials including, but not necessarily limited to, cloth, vinyl, tarp, nylon, plastic membrane, or any combination thereof.

The means for attachment may be made of materials such as, but not necessarily limited to, cable, rope, yarn, thread, wire, twine, line, cord, nylon, monofilament, or any combination thereof. The means for attachment may be used to connect a first frame to a second frame.

In specific embodiments, the means for attachment may be a piece of rope having a first end and a second end, with the first and second end each having a piece of magnetic metal attached thereto. The magnetic metal attached to the first end may be captured by the one or more magnetic strips on the facing of the first frame and the magnetic metal attached to the second end may be captured by the one or more magnetic strips on the facing of the second frame.

In some embodiments, the piece of magnetic metal attached to the first end of the rope is permanently affixed, while the piece of magnetic metal attached to the second end of the rope is adjustably connected to the rope by means of an adjustable anchor. The adjustable anchor allows one to change the length of the rope and the distance between the two frames. The adjustable anchor may be a line cleat having a base, a first lip, a second lip, and a notch. To shorten the rope, the rope may wrap around the cleat and be anchored in the notch of the cleat. The base may have a piece of magnetic metal attached on an end opposite the first and second lip, for attaching to a means of capturing a means for attachment. The line cleat may be made of materials including, but not necessarily limited to, metal, plastic, resin, fiberglass, or a combination thereof.

In some embodiments, the one or more means of attachment may connect a first frame to a second frame. In alternative embodiments, the one or more means of attachment may connect a first frame and a third frame to a second frame and a fourth frame.

In some embodiments, means of attachment may have a length of 2 feet or more. In some embodiments, the means of attachment may be a length of 6 feet.

In some embodiments, two or more frames may be connected to each other by two, three, four, five, six, seven, eight, nine, ten, eleven, twelve, thirteen, fourteen, fifteen, sixteen, seventeen, eighteen, nineteen, or twenty means for attachment. In some embodiments, two or more frames may be connected to each other by more than twenty means for attachment.

Preferably, each of the two or more frames is collapsible. In some embodiments, the frame members may be made of metal, plastic, PVC, wood, fiber glass, carbon fiber, or combinations thereof. In some embodiments, the frame members may have a tubular shape. In various embodiments, the tubular shape may be round tubular, triangular tubular, or square tubular.

In another aspect, provided herein is a gaming assembly having two or more frames, two or more facings, and one or more means for attachment. Each of the two or more frames may include two upright frame members connected by two or more crossbar frame members. The two upright frame members may each have the shape of a right triangle, including a first leg, a second leg, and a hypotenuse. The first leg of each right triangle may be configured to stand vertically and the second leg of each upright frame member may be configured to rest horizontally on the ground. The upper ends of the first leg of each upright frame member may be connected by a first crossbar frame member and the lower ends of the first leg of each upright frame member may be connected by a second crossbar frame member.

In some embodiments, the first crossbar frame member, the second crossbar frame member and the first legs of each upright frame member may define a vertical plane having a square shape. In other embodiments, the first crossbar frame member, the second crossbar frame member and the first leg of each upright frame members may define a vertical plane having a rectangular shape.

Each of the two or more facings may have a square or rectangular shape that is configured to fasten to the upright frame members and the crossbar frame members, and as such it is configured to cover the vertical plane.

The facings each have one or more means for capturing the one or more means for attachment. The one or more means for attachment may connect a first frame to a second frame.

In yet another aspect, provided herein is a method of using the gaming assembly described herein. The method may include the steps of a) unfolding the first and second upright frame members into their L shape configurations; b) attaching the first crossbar frame member to the upper ends of the upright frame members, attaching the second crossbar frame member to the angled crooks of the upright frame members, and attaching the third crossbar frame member to the lower ends of the upright frame members; c) repeating steps a) and b) one or more times to generate two or more frames; d) fastening a first facing to a first frame and a second facing to a second frame; e) attaching the first end of one means of attachment to one means of capturing the one or more means for attachment on the first facing and attaching the second end of the means of attachment to the one or more means of capturing the one or more means of attachment on the second facing; f) repeating step e) one or more times, thereby creating a field of gameplay having a crisscross of obstacle lines; g) entering the field of gameplay from one end for the purpose of reaching an opposite end without detaching any of the one or more means of attachment.

In some embodiments, steps a) and b) may be repeated sufficient times to generate four frames.

In some embodiments, each of the facings fastens to the upright frame members and the crossbar frame members by means of a releasable fastener, such as including, but not necessarily limited to, hook and loop attachments, slide fasteners, buttons, press buttons, magnets, hooks, thread, or a combination thereof.

In some embodiments, the length of the means for attachment may be adjusted by wrapping the means of attachment around a cleat.

In some embodiments, detachment of a means for attachment from one or more facings results in a loss of points for the player in the field of gameplay.

In yet another aspect, the invention provides a game kit having i) two or more collapsible frames; ii) two or more facings; iii) one or more means for attachment; and iv) a bag configured to hold the two or more collapsible frames, the two or more facings, and the one or more means for attachment.

In some embodiments, each collapsible frame includes a first upright frame member, a second upright frame member, and two or more crossbar frame members.

In some embodiments, each facing includes one or more means for capturing the one or more means for attachment.

In some embodiments, means for attachment may be a rope having a first end and a second end. In some embodiments, the first end has a piece of magnetic metal attached thereto and the second end has an adjustable anchor.

In specific embodiments, the first and second upright frame members have an L shape.

In some embodiments, the first and second upright frame members are each comprised of two or more parts that are connected to each other by an interlocking mechanism, and each of the crossbar frame members are connected to the upright frame members by an interlocking mechanism.

In some embodiments, each facing is configured to fasten to the upright frame members and crossbar frame members by means of a releasable fastener such as including, but not necessarily limited to, hook and loop attachments, slide fasteners, buttons, press buttons, magnets, hooks, thread, or a combination thereof.

In some embodiments, the facing is configured to fasten to the upright frame members and crossbar frame members by means of hook and loop attachments. In alternative embodiments, each facing is permanently attached to the first and second crossbar frame members by means of heat welding, glue, thread, staples, tape, or a combination thereof.

In some embodiments, each kit includes two collapsible frames, two facings, and nine means for attachment. In alternative embodiments, each kit includes four collapsible frames, four facings, and eighteen means for attachment.

In specific embodiments, the facings are made of cloth material and the means for attachment are made of rope.

The frame members may be made of metal, plastic, PVC, wood, fiber glass, carbon fiber, or a combination thereof.

These and other aspects, objects, features, and advantages of the example embodiments will become apparent to those having ordinary skill in the art upon consideration of the following detailed description of illustrated example embodiments.

BRIEF DESCRIPTION OF THE DRAWINGS

An understanding of the features and advantages of the present invention will be obtained by reference to the following detailed description that sets forth illustrative embodiments, in which the principles of the invention may be utilized, and the accompanying drawings of which:

FIG. 1A shows a perspective view of an exemplary frame assembly (100) with two upright frame members (104*a*, 104*b*), each having an L shape configuration. The two upright frame members are connected by three crossbar frame members (102*a*, 102*b*, 102*c*). FIG. 1B shows a perspective view of an exemplary frame assembly (200) with two upright frame members (216*a*, 216*b*), each having a triangular shape. The two upright frame members are connected by two crossbar frame members (210*a*, 210*b*). FIG. 1C shows a perspective view of an exemplary frame assembly (300) with two upright frame members, each having a rectangular shape. The two upright frame members are connected by two crossbar frame members.

FIG. 2A shows a plan view of an exemplary facing (500) having the shape of a cross-shaped dodecagon, with a top flap (502), a bottom flap (506), and two side flaps (504*a*, 504*b*). In the embodiment shown, there are three magnetic strips (508*a*, 508*b*, 508*c*) running horizontally from one end to the other. FIG. 2B shows a plan view of an exemplary facing (600) having the shape of a cross-shaped dodecagon, with a top flap (602), a bottom flap (606), and two side flaps (604*a*, 604*b*). In the embodiment shown, there are nine magnetic strips (608*a*, 608*b*, 608*c*, etc.) arranged in a segmented pattern. FIG. 2C shows a plan view of an exemplary facing (700) having a rectangular shape, with nine magnetic strips (708*a*, 708*b*, 708*c*, etc.) arranged in a segmented pattern. FIG. 2D shows a perspective view of an exemplary frame assembly (100) and FIG. 2E shows the facing (500) from FIG. 2A fastened to the frame assembly (100) from FIG. 2D.

FIGS. 5A, 5C, and 5E show various perspective views. FIG. 5B shows a front view, illustrating the base (824), first lip (822*a*), second lip (822*b*), and notch (826). FIG. 5D shows a bottom perspective view, with the bottom portion of the base having a space (828) for receiving a piece of magnetic metal.

The figures herein are for illustrative purposes only and are not necessarily drawn to scale.

DETAILED DESCRIPTION OF THE EXAMPLE EMBODIMENTS

General Definitions

As used herein, the singular forms "a", "an", and "the" include both singular and plural referents unless the context clearly dictates otherwise.

The term "optional" or "optionally" means that the subsequent described event, circumstance or substituent may or may not occur, and that the description includes instances where the event or circumstance occurs and instances where it does not.

The recitation of numerical ranges by endpoints includes all numbers and fractions subsumed within the respective ranges, as well as the recited endpoints.

The terms "about" or "approximately" as used herein when referring to a measurable value such as a parameter, an amount, a temporal duration, and the like, are meant to encompass variations of and from the specified value, such as variations of +/−10% or less, +/−5% or less, +/−1% or less, and +/−0.1% or less of and from the specified value, insofar such variations are appropriate to perform in the disclosed invention. It is to be understood that the value to which the modifier "about" or "approximately" refers is itself also specifically, and preferably, disclosed.

Various embodiments are described hereinafter. It should be noted that the specific embodiments are not intended as an exhaustive description or as a limitation to the broader aspects discussed herein. One aspect described in conjunction with a particular embodiment is not necessarily limited to that embodiment and can be practiced with any other embodiment(s). Reference throughout this specification to "one embodiment", "an embodiment," "an example embodiment," means that a particular feature, structure or characteristic described in connection with the embodiment is included in at least one embodiment of the present invention. Thus, appearances of the phrases "in one embodiment," "in an embodiment," or "an example embodiment" in various places throughout this specification are not necessarily all referring to the same embodiment, but may. Furthermore, the particular features, structures or characteristics may be combined in any suitable manner, as would be apparent to a person skilled in the art from this disclosure, in one or more embodiments. Furthermore, while some embodiments described herein include some but not other features included in other embodiments, combinations of features of different embodiments are meant to be within the scope of the invention. For example, in the appended claims, any of the claimed embodiments can be used in any combination.

All publications, published patent documents, and patent applications cited herein are hereby incorporated by reference to the same extent as though each individual publication, published patent document, or patent application was specifically and individually indicated as being incorporated by reference.

Overview

Figure 3:
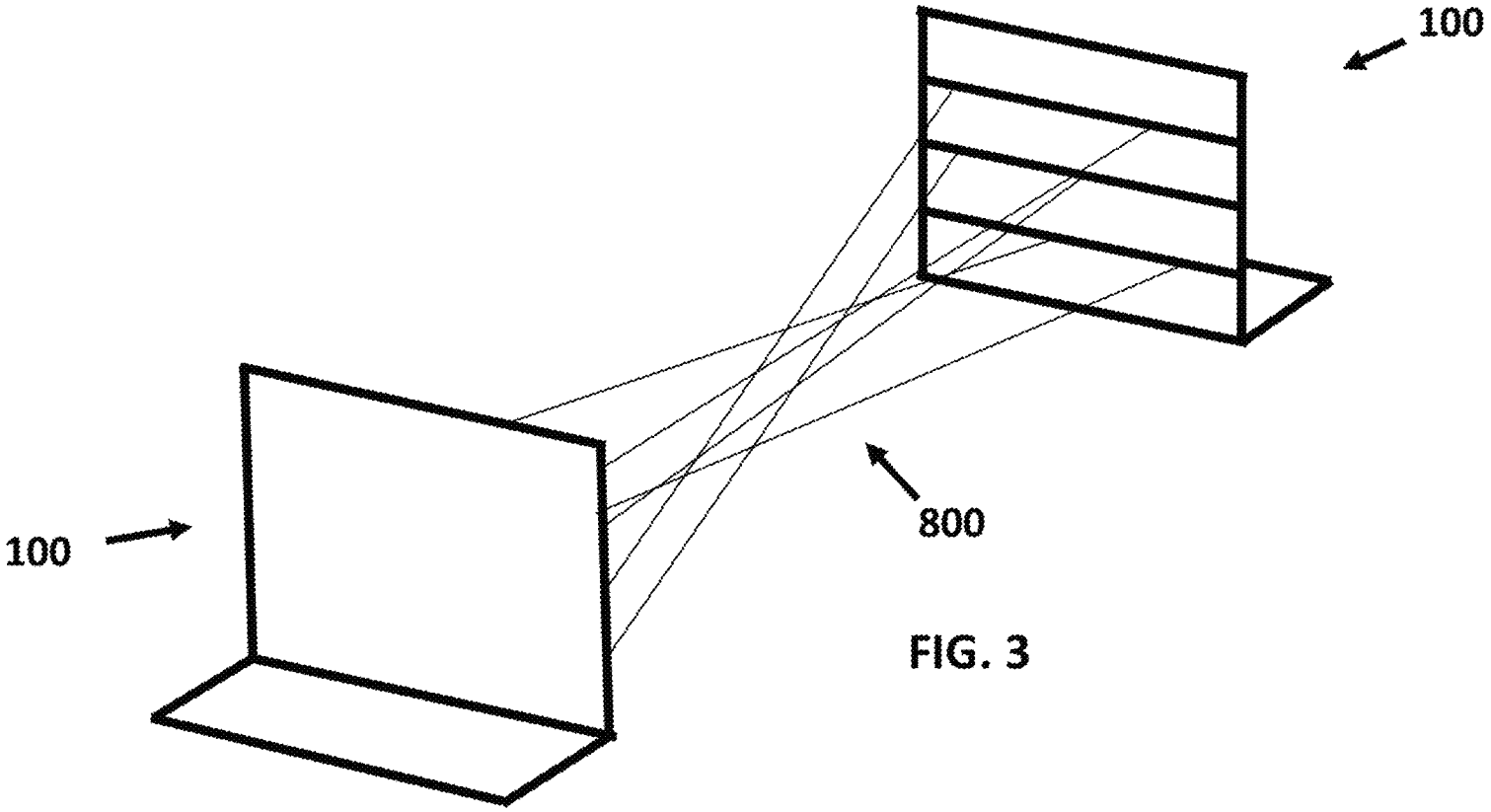
FIG. 3—Shows a perspective view of one frame (100) connected to one other frame (100) by six means of attachment (800).

The invention comprises a gaming assembly that can be assembled in a variety of configurations as described herein and as illustrated in the figures. The aim of the player is to traverse an obstacle course defined by at least two frames that are connected by elements such as ropes as shown in FIG. 3. The ropes can be attached in a variety of arrangements to increase or decrease the level of difficulty of the game. Each player must traverse the obstacle course without disconnecting the ropes from the frames or facings. The player with the most ropes attached after traversing the obstacle course wins. The players do not need any specific gear to play the game once the obstacle course is assembled.

Assemblies

1. Frames

Disclosed herein are gaming assemblies comprising two or more collapsible frames. Each frame may be composed of two or more upright frame members that are connected by one or more crossbar frame members. The frame and frame members may be made of solid or hollow material. In some embodiments, the material may be plastic tubing. In other embodiments, the material may be metal, PVC, wood, fiber glass, carbon fiber, or combinations thereof. The individual frame members may be connected to each other by an interlocking mechanism. The term "interlocking", as used herein, refers to two or more things engaging or fitting with each other by overlapping or by the fitting together of projections and recesses. The fitting or engaging with each other may be as parts of a machinery, so that all action is synchronized. The individual frame members may be connected to each other by any means known in the art, such as with elbow fittings, friction joints, or couplers. In some embodiments, the frame members may have a tubular shape. In some embodiments, the tubular shape may be round tubular, triangular tubular, or square tubular. The frames are collapsible, and as such, are designed to be folded into a smaller shape or size for easy storage and transport.

In some embodiments, the frame may be constructed of a sequence of individual frame members that are hollow, and connect to one another on an end-to-end basis. An elastic cord runs through each of the tubular members, and is placed in a stretched configuration when the tubular members are slideably connected together, end-to-end. The elastic cord thereby applies a compressive force against the connected frame members, resisting the unintentional disassembly thereof. When storage or transport is required, the individual members slide apart, with the elastic cord maintaining the sequential order of the frame members.

In some embodiments, the frame may be composed of a first upright frame member and a second upright frame member that are connected to each other by one or more crossbar frame members. In some embodiments, each of the first and second upright frame members may have an L shape. In other embodiments, each of the first and second upright frame members may have a triangular shape. In yet other embodiments, each of the first and second upright frame members may have a square shape or a rectangular shape.

Figure 1A:
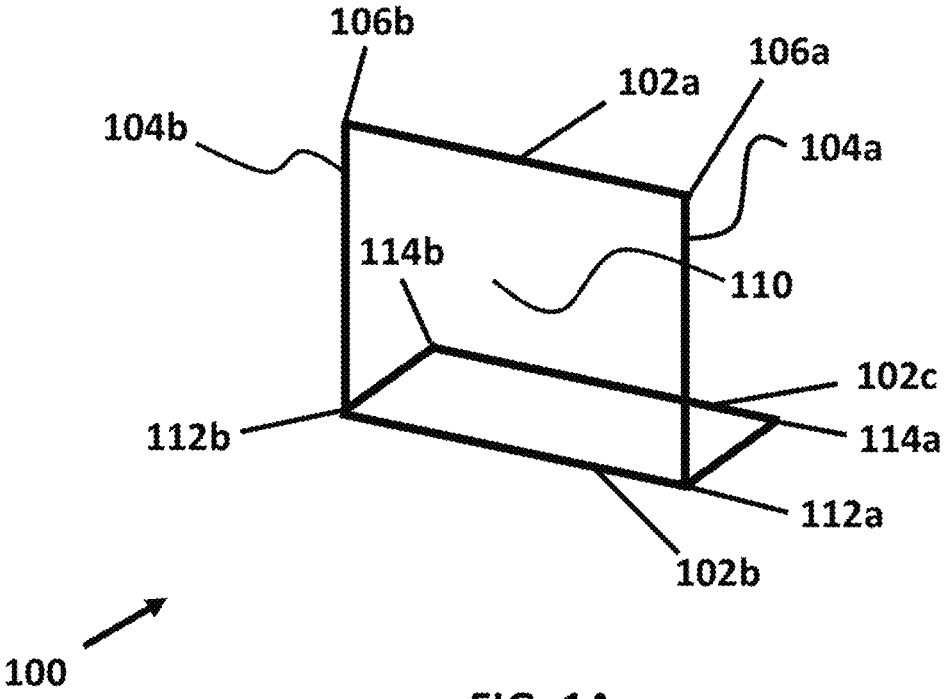
FIGS. 1A-1C—Show different exemplary embodiments of various frame assemblies.

In a preferred embodiment illustrated in FIG. 1A, the first and second upright frame members (104*a*, 104*b*) are each in the shape of an L when assembled, with an upper end (106*a*, 106*b*), a lower end (114*a*, 114*b*), and an angled crook (112*a*, 112*b*) defining the L. To construct the frame, a first (102*a*), second (102*b*), and third crossbar frame member (102*c*) may be used to connect the upper ends, the angled crooks, and the lower ends of each upright frame member, respectively. As such, in the assembled frame, the first crossbar frame member, the second crossbar frame member, and the first and second upright frame members define a vertical plane (110). The vertical plane may have a rectangular shape or a square shape in various embodiments.

Figure 1B:
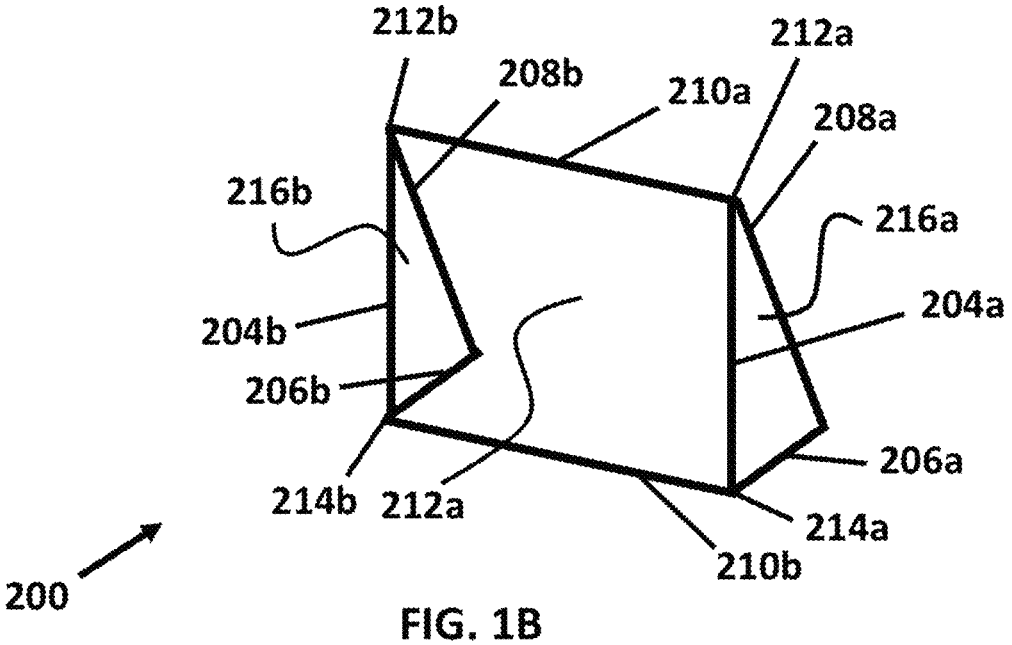

In an alternative embodiment pictured in FIG. 1B, the first and second upright frame members (216*a*, 216*b*) may each be in the shape of a right triangle. The right triangle is defined by a first leg (204*a*, 204*b*), a second leg (206*a*, 206*b*), and a hypotenuse (208*a*, 208*b*), with the first leg configured to stand vertically and the second leg resting horizontally on the ground. The upper ends (212*a*, 212*b*) of the first leg of each upright frame member may be connected by a first crossbar frame member (210*a*) and the lower ends (214*a*, 214*b*) of the first leg of each upright frame member may be connected by a second crossbar frame member (210*b*). As such, the first crossbar frame member, the second crossbar frame member, and the first legs of each upright frame members may define a vertical plane having a rectangular or square shape.

Figure 1C:
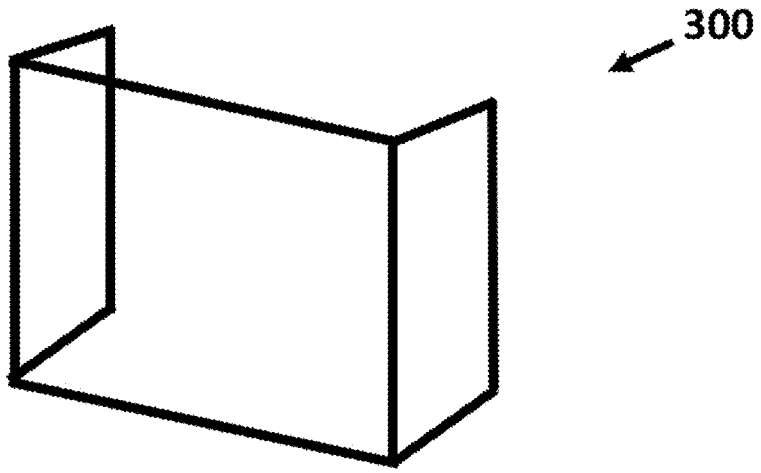

In alternative non-limiting embodiments, the first and second upright frame members may each define the shape of a square, or the shape of a rectangle, as illustrated in FIG. 1C.

In some embodiments, the upright frame members may range in height from 2 feet to 5 feet. In a preferred embodiment, the upright frame members are 3 feet tall.

In some embodiments, the portion of the upright frame members reaching from the angled crook to the lower end may range in length from 1 to 4 feet. In a preferred embodiment, the length of this portion is 2 feet.

In some embodiments, the crossbar frame members range in length from 3 to 6 feet. In a preferred embodiment, the crossbar frame members are 4 feet in length.

2. Facings

Also envisioned within the scope of the invention are facings that are configured to attach, or fasten, to the frames. The facings may have a rectangular or square shape that is configured to fasten to the upright frame members and the crossbar frame members, thereby covering the vertical plane defined by the upright frame members and crossbar frame members. The facing may completely cover the vertical plane defined by the upright frame members and crossbar frame members. In some embodiments, the facing may incompletely cover the vertical plane defined by the upright frame members and crossbar frame members, leaving an empty margin along each edge. In some embodiments, the mechanism of fastening or attachment may include, but is not necessarily limited to, a releasable fastener such as hook and loop attachments, slide fasteners, buttons, press buttons, magnets, hooks, thread, straps, clips, or a combination thereof. Any such releasable fastening mechanism is temporary and capable of being reversed. In alternative embodiments, the mechanism of fastening or attachment may be a means of permanent fastening, such as, but not necessarily limited to, heat welding, glue, thread, staples, tape, bolts, screws, pins, rods, or a combination thereof. As such, a frame having a facing permanently attached thereto, will not be disassembled from the facing for the purposes defined herein.

Figure 2A:
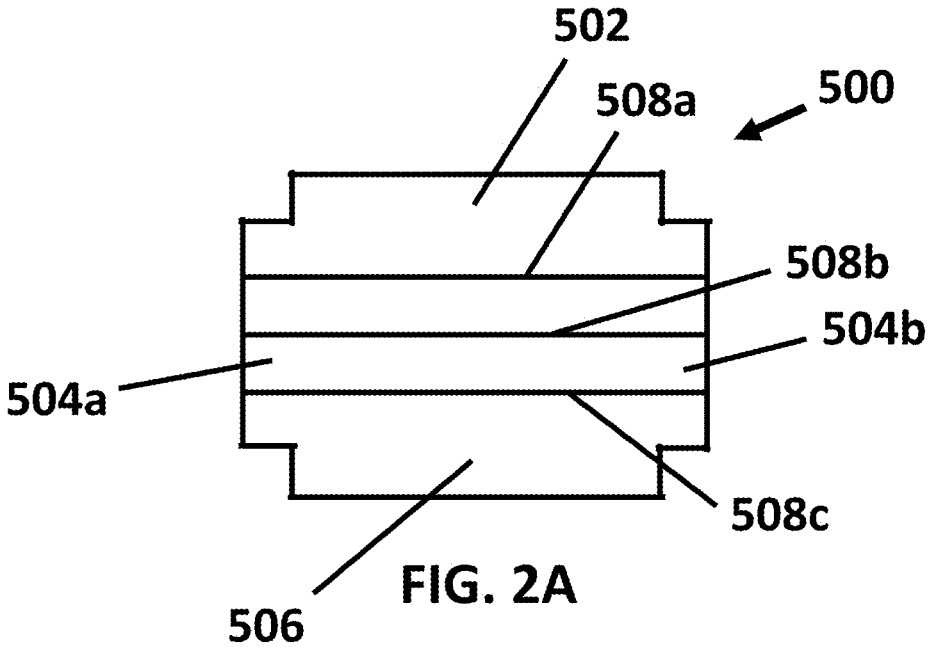
FIGS. 2A-2E—Show different embodiments of various facings and facings attached to a frame.
Figure 2B:
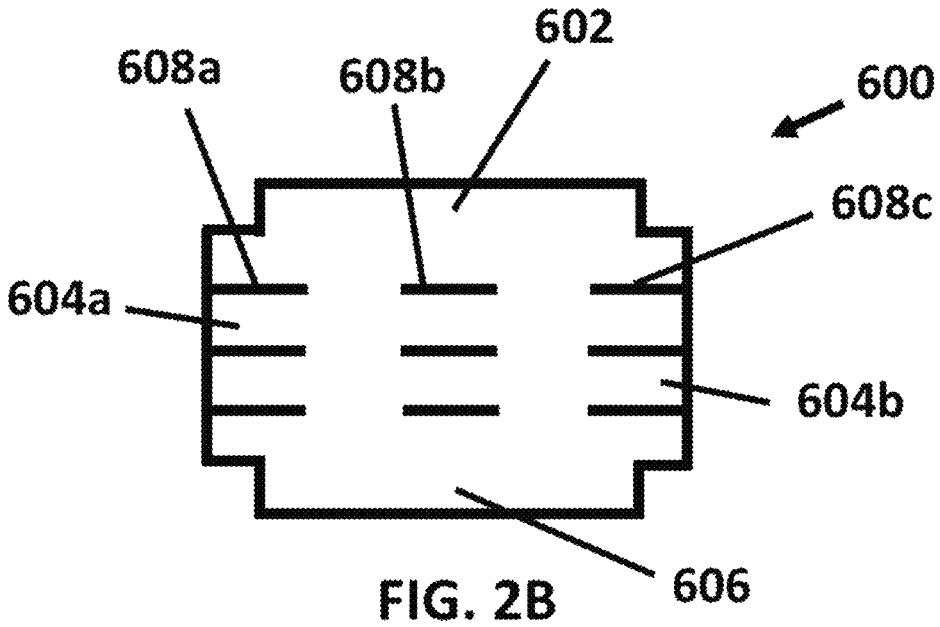

The facing may have any suitable shape. In specific embodiments, the facing (500, 600) may have the shape of a cross-shaped dodecagon, with a top flap (502, 602), a bottom flap (506, 606), and two side flaps (504*a*, 504*b*, 604*a*, 604*b*), as illustrated in FIGS. 2A and 2B. The top flap, the bottom flap, and the two side flaps may be configured to fasten around the first crossbar frame member, the second crossbar frame member, and the first and second upright frame members, respectively, to yield a frame as illustrated in FIG. 2E.

Figure 2C:
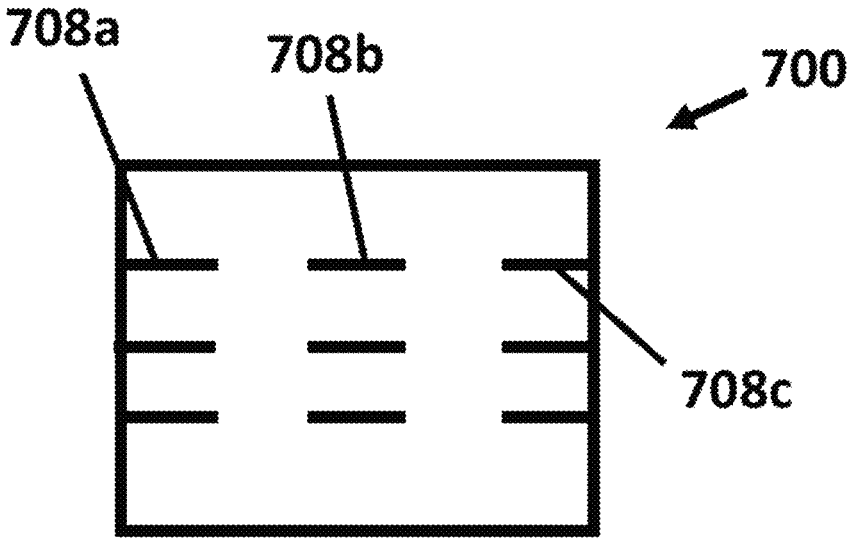
Figure 2D:
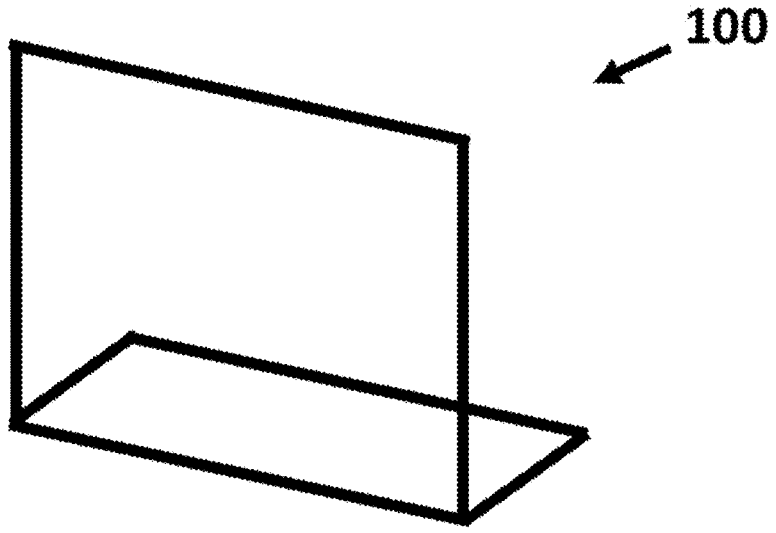
Figure 2E:
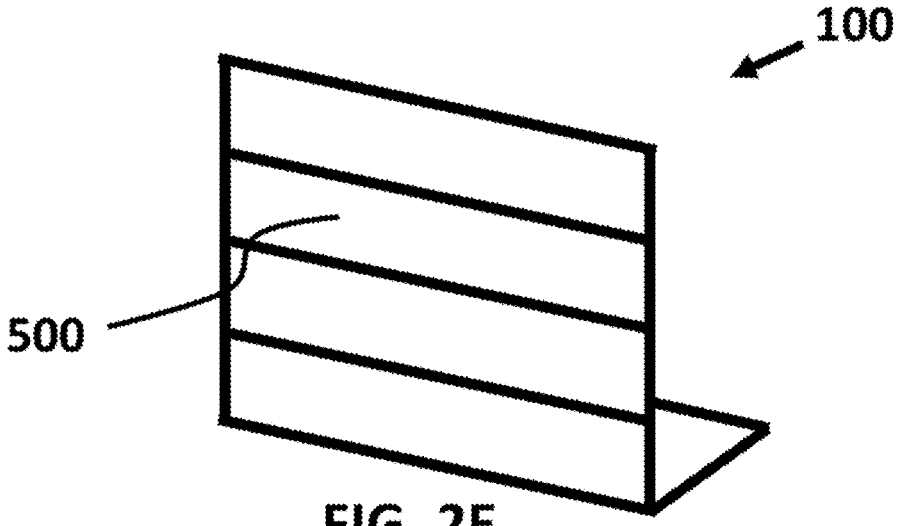

In other embodiments, the facing (700) may be square shaped, or rectangular, as illustrated in FIG. 2C.

The facing may also have one or more means of capturing (508*a*, 508*b*, 508*c*, 608*a*, 608*b*, 608*c*, 708*a*, 708*b*, 708*c*) one or more means for attachment, as further described below. The term "capture" or "capturing" as used herein, refers to the ability to catch, apprehend, seize, grab, nab, take possession of. In certain embodiments, the facing may have two or more, three or more, four or more, five or more, six or more, seven or more, eight or more, nine or more means for capturing the one or more means for attachment. In specific embodiments, the facing may have nine means for capturing one or more means for attachment. Any suitable means for capturing the means for attachment known in the art may be used, such as, but not necessarily limited to, hook and loop attachments, magnetic strips, adhesive tape, or any combination thereof. In specific embodiments, the means for capturing the means for attachment is one or more magnetic strips.

The means for capturing the one or more means for attachment may run the length of the facing, as illustrated in FIG. 2A (features 508*a*, 508*b*, 508*c*), or they may be arranged in a segmented pattern, as shown in FIGS. 2B (features 608*a*, 608*b*, 608*c*, etc.) and 2C (features 708*a*, 708*b*, 708*c*).

In particular embodiments, the facing may be foldable. In some embodiments, the facing may be made of canvas, cloth, vinyl, tarp, nylon, plastic membrane, or any combination thereof.

In some embodiments, the facing may measure to be 2 feet tall by 3 feet wide, 3 feet tall by 4 feet wide, 4 feet tall by 5 feet side, 5 feet tall by 6 feet wide, or anywhere in between. In a preferred embodiment, the vertical plane is 3 feet tall by 4 feet wide.

3. Means for Attachment

Also envisioned within the scope of the invention are means for attachment, allowing one to connect one frame to another frame. The term "connect", as used herein, refers to the act of joining, linking, or coupling one entity to another. The means for attachment may be composed of materials including, but not necessarily limited to, cable, rope, yarn, thread, wire, twine, line, cord, nylon, monofilament, or any combination thereof.

Figure 4:
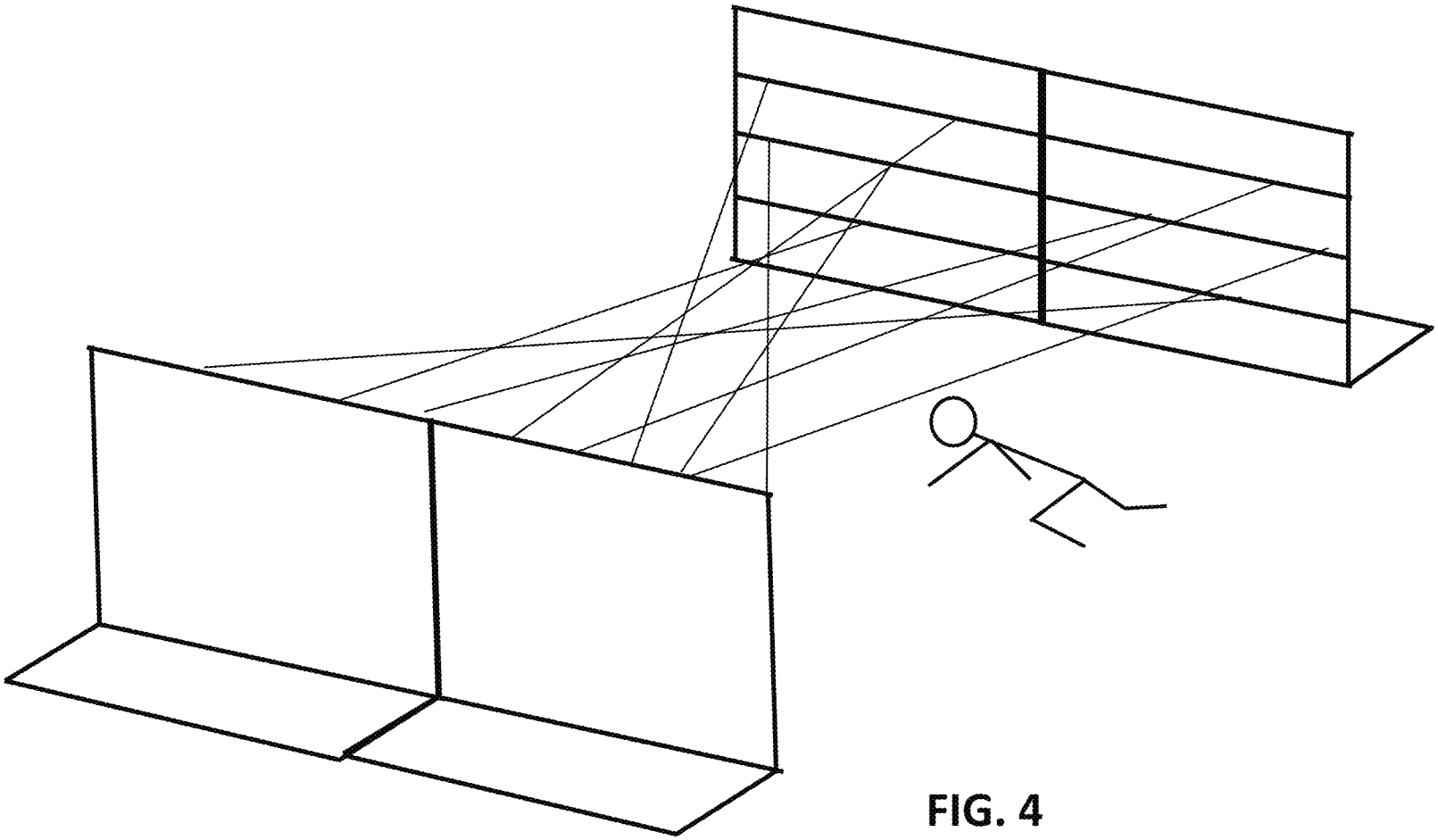
FIG. 4—Shows a perspective view of two frames arranged side by side, connected to two other frames, also arranged side by side, by 9 means of attachment. Also shown is a prospective player traversing the obstacle course.

In specific embodiments, the means for attachment may be a piece of rope having a first end and a second end, the first and second end each having a releasable fastener attached thereto. The releasable fastener may include, but is not necessarily limited to, hook and loop attachments, adhesive tape, or magnetic metal. In specific embodiments, the means for attachment is a piece of rope with a piece of magnetic metal attached to each end. As such, the magnetic metal attached to the first end is captured by the one or more magnetic strips on the facing of a first frame and the magnetic metal attached to the second end is captured by the one or more magnetic strips on the facing of a second frame, thereby allowing one to construct the assembly illustrated in FIG. 3. In other embodiments, a first set of two or more frames can be arranged side by side, with a second set of two or more additional frames arranged side by side facing the first set. As such, one or more means for attachment can be used to connect a first frame and a third frame to a second frame and a fourth frame, as illustrated in FIG. 4.

In some embodiments, the piece of magnetic metal attached to the first end of the rope is permanently affixed. In some embodiments, the piece of magnetic metal attached to the second end of the rope is adjustably connected to the rope by means of an adjustable anchor, allowing one to change the length of the rope and the distance between the two frames. In some embodiments, the means for attachment may have an adjustable anchor on each end.

In some embodiments, the one or more means of attachment comprise a length of 2 feet or more. In some embodiments, the one or more means of attachment has a length ranging between 2 feet and 10 feet. In specific embodiments, the one or more means of attachment may have a length of 6 feet.

In some embodiments, an assembly as described herein may have two, three, four, five, six, seven, eight, nine, ten, eleven, twelve, thirteen, fourteen, fifteen, sixteen, seventeen, eighteen, nineteen, or twenty means for attachment. In some embodiments, the assembly may have more than twenty means for attachment. In some embodiments, the assembly comprises a tunnel through which the players travers.

Figure 5A:
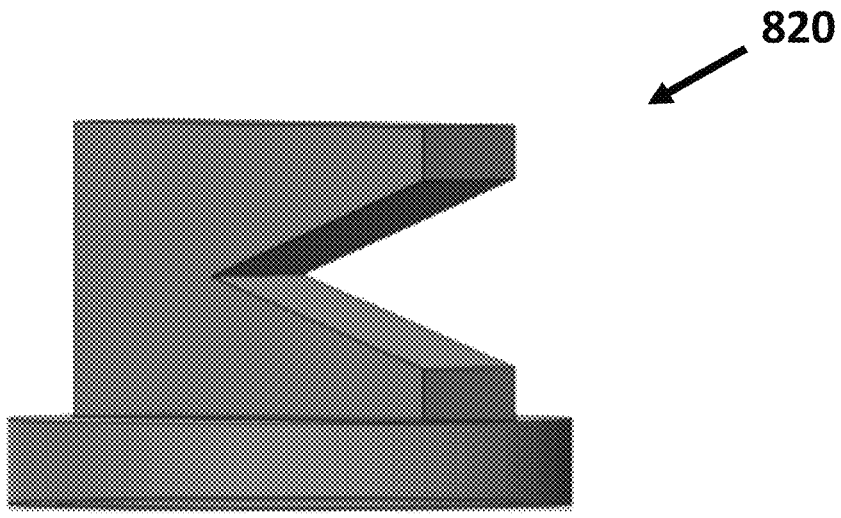
FIGS. 5A-5E—Show various views of an exemplary adjustable anchor (820).
Figure 5B:
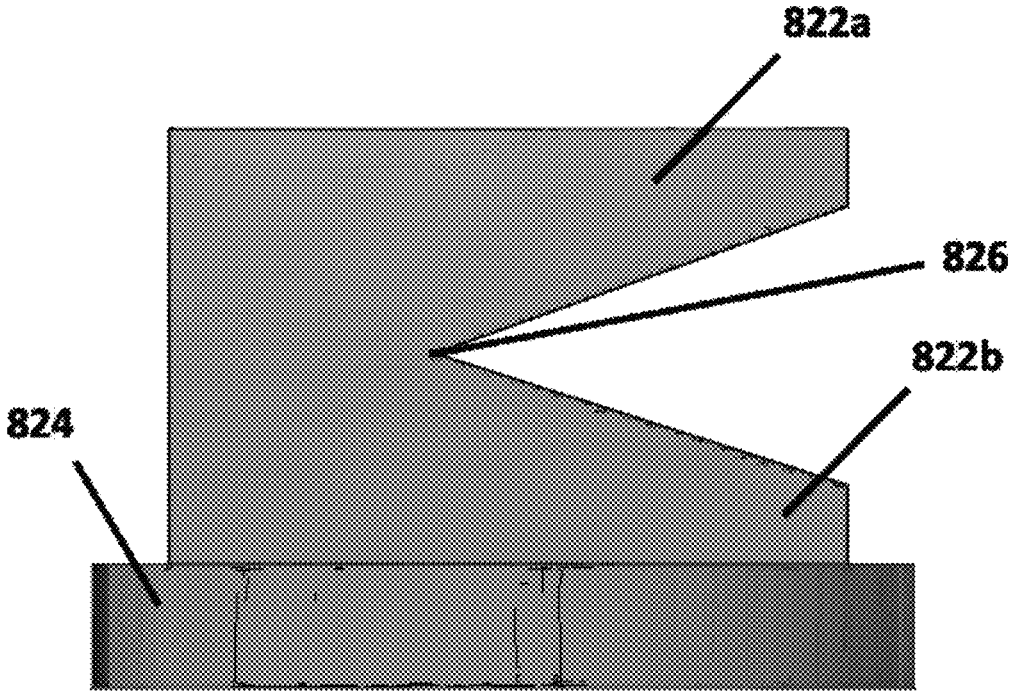
Figure 5C:
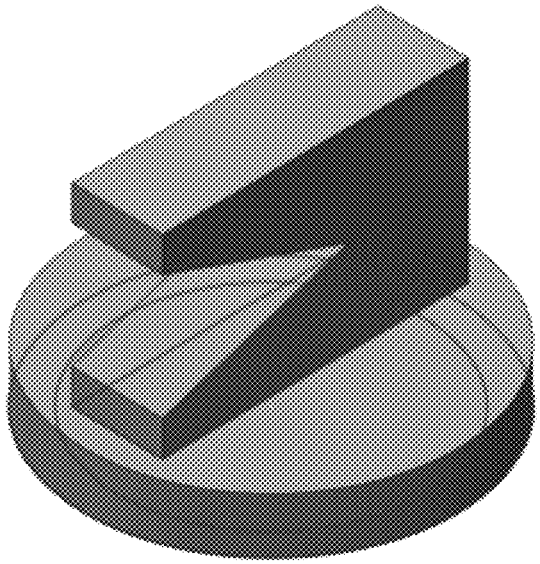
Figure 5D:
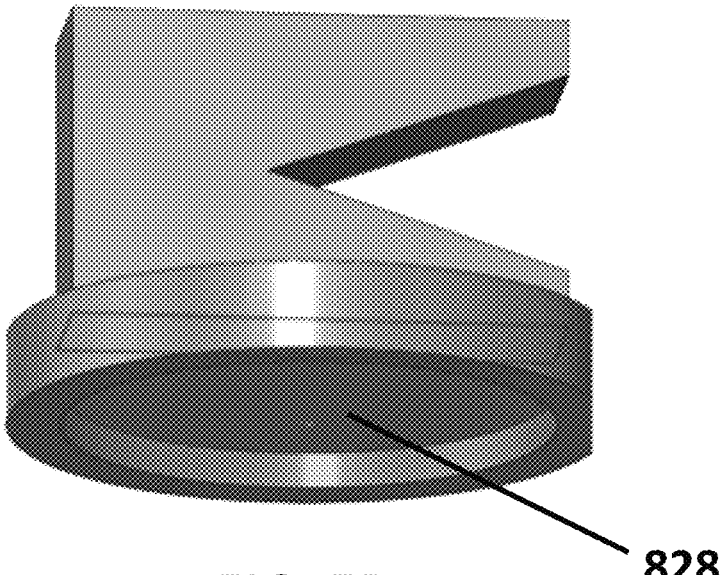
Figure 5E:
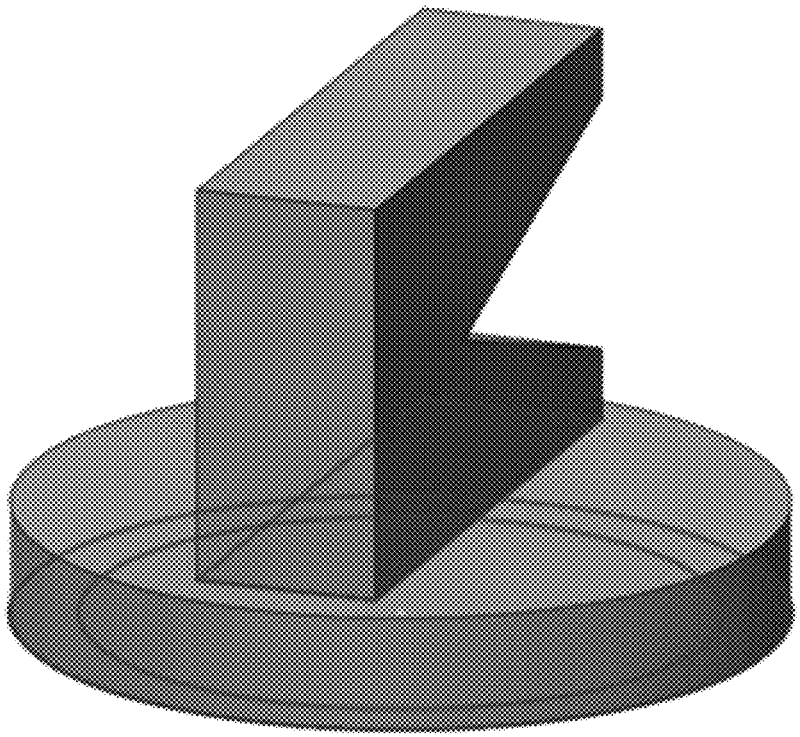
Figure 6:
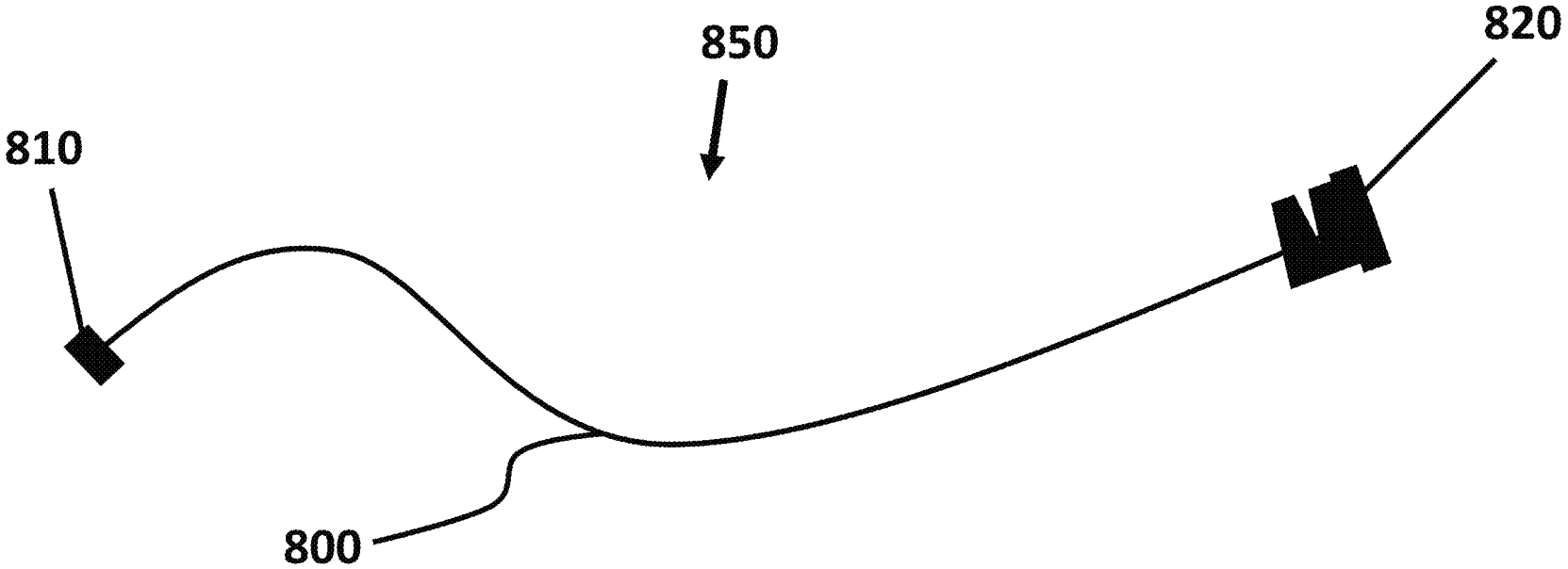
FIG. 6—Shows an exemplary means for attachment (800), with a piece of magnetic metal (810) attached to one end of a rope (850) and an adjustable anchor (820) attached to the other end.

An adjustable anchor may be any device known in the art, such as a ratchet, cog, wheel, cogwheel, pulley, line cleat, tent cord, or line tightener. In specific embodiments, the adjustable anchor is a line cleat (820) as shown in FIGS. 5A-5E and FIG. 6. The line cleat may have a base (824,) a first lip (822*a*), a second lip (822*b*), and a notch (826) as shown in FIG. 5B. In this embodiment, the rope may wrap around the cleat and is anchored in the notch of the cleat. The base of the line cleat may have a space (828) on the end opposite the first and second lip for receiving a piece of magnetic metal. The magnetic metal may be permanently affixed to this space, allowing the means for attachment to be captured by a magnetic strip on a facing of a frame assembly. The line cleat may be composed of metal, plastic, resin, fiberglass, or a combination thereof.

Methods

Also envisioned within the scope of the invention are methods for using the gaming assemblies described herein. Such methods may involve the steps of a) unfolding the first and second upright frame members;

b) attaching the first crossbar frame member to the upper ends of the upright frame members, attaching the second crossbar frame member to the angled crooks of the upright frame members, and attaching the third crossbar frame member to the lower ends of the upright frame members;

c) repeating steps a) and b) one or more times to generate two or more frames;

d) fastening a first facing to a first frame and a second facing to a second frame;

e) attaching the first end of one means of attachment to one means of capturing the one or more means for attachment on the first facing and attaching the second end of the means of attachment to the one or more means of capturing the one or more means of attachment on the second facing;

f) repeating step e) one or more times, thereby creating a field of gameplay having a crisscross of obstacle lines;

g) entering the field of gameplay from one end for the purpose of reaching an opposite end without detaching any of the one or more means of attachment.

In some embodiments, the first and second upright frame members may have L-shaped, triangular, square, or rectangular configurations, as described herein. In a preferred embodiment, the first and second upright frame members are L-shaped when assembled. As described herein, the frames are collapsible and are designed to be folded into a smaller shape or size for easy storage and transport. As such, the frame members may also be opened, expanded, or unfolded from their storage configuration so that the individual frame members may be connected to each other by an interlocking mechanism. The individual frame members may be connected to each other by any means known in the art, such as with elbow fittings, friction joints, or couplers.

In some embodiments, the frame may be constructed of a sequence of individual frame members that are hollow, and connect to one another on an end-to-end basis. An elastic cord runs through each of the tubular members, and is placed in a stretched configuration when the tubular members are slideably connected together, end-to-end. The elastic cord thereby applies a compressive force against the connected frame members, resisting the unintentional disassembly thereof. When storage or transport is required, the individual members slide apart, with the elastic cord maintaining the sequential order of the frame members.

In specific embodiments, steps a) and b) of the above-described method may be repeated enough times to generate four or more frames.

In some embodiments, each of the facings may fasten to the upright frame members and the crossbar frame members by means of releasable fasteners, such as hook and loop attachments, slide fasteners, buttons, press buttons, magnets, hooks, thread, or a combination thereof. Any such releasable fastening mechanism is temporary and capable of being reversed. In other embodiments, the facings may be fastened to the upright frame members permanently, such as by heat welding, glue, thread, staples, tape, bolts, screws, pins, rods, or a combination thereof. As such, a frame having a facing permanently attached thereto, will not be disassembled from the facing for the purposes defined herein. In yet other embodiments, the facings may be permanently fastened to the crossbar frame members. In the latter embodiments, step d) from the above listed steps may be skipped.

In attaching the first end of one means of attachment to one means of capturing the means for attachment located on the facing of one frame and attaching the second end of the same means of attachment to another means of capturing the means for attachment located on the facing of a second frame, an obstacle line is created. In repeating this step multiple times, a crisscross of obstacle lines is created, thus generating a field of gameplay, as illustrated in FIGS. 3 and 4. As used herein, the term "obstacle" or "obstacle line" refers to a barrier, hurdle, impediment, obstruction, block, hindrance, or deterrent.

As described herein, the length of the means for attachment may be adjusted by use of an adjustable anchor. As described herein, the means for attachment may be a cable, rope, yarn, thread, wire, twine, line, cord, monofilament, or any combination thereof. An adjustable anchor may be any device known in the art, such as a ratchet, cog, wheel, cogwheel, pulley, line cleat, tent cord, or line tightener. In specific embodiments, the means for attachment is a rope and the adjustable anchor is a line cleat (820) as shown in FIGS. 5A-5E and FIG. 6. As such, the end of the rope that is adjacent to the line cleat may be wrapped around the line cleat and anchored in the notch of the cleat. In some embodiments, both ends of the rope may have a line cleat. The magnetic metal affixed to the base of the line cleat may be used to attach the rope to the magnetic strip on a facing of a frame assembly.

During the course of gameplay, a player may enter the field of gameplay or obstacle course from one end for the purpose of reaching the opposite end without detaching any of the one or more ropes, or means of attachment. Detachment may occur when a rope or means of attachment is no longer attached to two means for capturing a means for attachment. As such, detachment may occur when only a first or only a second end of a rope or means of attachment is attached to a means for capturing a means for attachment. Expressed alternatively, detachment may occur when one end of a rope or means of attachment is no longer attached to one means for capturing a means for attachment, while the second end of the rope or means of attachment is still attached to a second means for capturing a means for attachment. Detachment also occurs when both the first end and the second end of the rope or means of attachment are no longer attached to their respective means for capturing a means for attachment.

In some embodiments, detachment of a means for attachment from one or more facings results in a loss of points for the player in the field of gameplay. The means for attachment may then be reattached to their respective means for capturing a means for attachment, re-creating the original field of gameplay. Another player may then begin playing the game by entering the field of gameplay from one end, for the purpose of reaching an opposite end without detaching any of the one or more means of attachment. This game may be played by individual players or may employ teams of players.

Detachment of the one or more means for attachment can be avoided by walking, crawling, climbing, creeping, dragging, inching, sliding, wriggling, worming, slithering in between the means for attachment without touching the means for attachment. In some embodiments, these motions may require the player to crawl on hands and knees. In some embodiments, these motions may require the player to lift legs, arms and torso as needed to avoid touching or detaching the one or more means for attachment.

In some embodiments, the invention comprises a timed game in which the person who traverses the field of gameplay or obstacle course in the least amount of time with the most ropes still attached, wins.

Kits

Also envisioned within the scope of the invention are game kits that may include i) two or more collapsible frames;

ii) two or more facings, wherein each facing comprises one or more means for capturing the one or more means for attachment;

iii) one or more means for attachment comprising a rope having a first end and a second end, wherein the first end comprises a piece of magnetic metal attached thereto and the second end comprises an adjustable anchor; and iv) a bag configured to hold the two or more collapsible frames, the two or more facings, and the one or more means for attachment.

As described herein, the collapsible frames may include a first upright frame member and a second upright frame member, and two or more crossbar frame members. As described herein, in some embodiments, the facing may be included in the kit separately from the individual frame members and may thus require attachment to the respective frame members to cover the vertical plane and generate a surface for attachment of the one or more means for attachment. In some embodiments, the facings are permanently attached to the upright frame members. In other embodiments, the facings are permanently attached to the crossbar frame members. Temporary or releasable means for attaching the facings to the frame members are described herein, but may include hook and loop attachments, slide fasteners, buttons, press buttons, magnets, hooks, thread, or a combination thereof. Permanent means for attaching the facings to the frame members are described herein, but may include heat welding mechanisms, glue, thread, staples, tape, or a combination of these mechanisms. In specific embodiments, the facing is configured to fasten to the upright frame members and crossbar frame members by means of hook and loop attachments.

As described herein, the first and second upright frame members may be L-shaped, triangle-shaped, square-shaped or rectangular. In a preferred embodiment, the first and second upright frame members are L-shaped when assembled.

As described herein, the first and second upright frame members may each be composed of two or more parts that are connected to each other by an interlocking mechanism. As described herein, each of the crossbar frame members may be connected to the upright frame members by an interlocking mechanism. Such interlocking mechanisms may include, but are not necessarily limited to, elbow fittings, friction joints, or couplers. Such mechanisms may be included in the kit as separate parts, or may already be attached to the frame members. In some embodiments, the frame members may have a tubular shape. In some embodiments, the tubular shape may be round tubular, triangular tubular, or square tubular. The frames are collapsible, and as such, are designed to be folded into a smaller shape or size for easy storage and transport.

As described herein, in some embodiments, the frame may be constructed of a sequence of individual frame members that are hollow, and connect to one another on an end-to-end basis. An elastic cord may run through each of the tubular members, and is placed in a stretched configuration when the tubular members are slideably connected together, end-to-end. The elastic cord thereby applies a compressive force against the connected frame members, resisting the unintentional disassembly thereof. When storage or transport is required, the individual members slide apart, with the elastic cord maintaining the sequential order of the frame members.

In some embodiments, the game kit may include two collapsible frames, two facings, and nine means for attachment. In alternative embodiments, the game kit may include four collapsible frames, four facings, and eighteen means for attachment.

In some embodiments, the facings are made of cloth material and the means for attachment are comprised of rope, as described herein.

In some embodiments, the frame members are comprised of metal, plastic, PVC, wood, fiber glass, carbon fiber, or a combination thereof.

In some embodiments, the vertical plane, and as such, the facing, may be 2 feet by 3 feet, 3 feet by 4 feet, 4 feet by 5 feet, 5 feet by 6 feet. In a preferred embodiment, the vertical plane is 4 feet wide and 3 feet tall.

Various modifications and variations of the described methods, compositions, and kits of the invention will be apparent to those skilled in the art without departing from the scope and spirit of the invention. Although the invention has been described in connection with specific embodiments, it will be understood that it is capable of further modifications and that the invention as claimed should not be unduly limited to such specific embodiments. Indeed, various modifications of the described modes for carrying out the invention that are obvious to those skilled in the art are intended to be within the scope of the invention. This application is intended to cover any variations, uses, or adaptations of the invention following, in general, the principles of the invention and including such departures from the present disclosure come within known customary practice within the art to which the invention pertains and may be applied to the essential features herein before set forth.

What is claimed is:

1. A gaming assembly comprising two or more frames, two or more facings, and one or more means for attachment;

wherein each of the two or more frames comprises two upright frame members connected by two or more crossbar frame members;

wherein the two upright frame members each comprise the shape of a right triangle comprising a first leg, a second leg, and a hypotenuse;

wherein the first leg of each right triangle is configured to stand vertically and the second leg of each upright frame member is configured to rest horizontally on the ground;

wherein the upper ends of the first leg of each upright frame member are connected by a first crossbar frame member and the lower ends of the first leg of each upright frame member are connected by a second crossbar frame member;

wherein the first crossbar frame member, the second crossbar frame member and the first legs of each upright frame members define a vertical plane having a rectangular shape;

wherein each of the two or more facings comprises a rectangular shape that is configured to fasten to the upright frame members and the crossbar frame members; and wherein it covers the vertical plane;

wherein the two or more facings each further comprise one or more means for capturing the one or more means for attachment; and wherein the one or more means for attachment connects a first frame to a second frame.

2. The assembly of claim 1, wherein each of the two or more facings fastens to the upright frame members and crossbar frame members by means of a releasable fastener selected from the group consisting of hook and loop attachments, slide fasteners, buttons, press buttons, magnets, hooks, thread, and a combination thereof; or wherein each of the two or more facings fastens to the upright frame members and the crossbar frame members by means of a permanent fastening mechanism selected from the group consisting of heat welding, glue, thread, staples, tape, and a combination thereof.

3. The assembly of claim 1, wherein the one or more means of attachment comprise a length of 2 feet or more; optionally a length of 6 feet.

4. The assembly of claim 1, wherein each of the two or more frames is collapsible;

wherein the frame members comprise a tubular shape and are comprised of metal, plastic, PVC, wood, fiber glass, carbon fiber, or combinations thereof.

5. A gaming assembly comprising two or more frames, two or more facings, and one or more means of attachment, wherein each of the two or more frames comprises a first upright frame member and a second upright frame member connected by a first crossbar frame member and a second crossbar frame member, wherein each of the two or more facings comprises the shape of a cross-shaped dodecagon, comprising a top flap, a bottom flap, and two side flaps;

wherein the top flap, the bottom flap, and the two side flaps are configured to fasten around the first crossbar frame member, the second crossbar frame member, and the first and second upright frame members, respectively;

wherein the two or more facings each further comprise one or more two or more, three or more, four or more, five or more, six or more, seven or more, eight or more, nine or more means for capturing the one or more means for attachment;

wherein the means for capturing the one or more means for attachment are selected from the group consisting of hook and loop attachment, magnetic strips, and adhesive tape; wherein each of the two or more facings are foldable and are comprised of cloth, vinyl, tarp, nylon, plastic membrane, or any combination thereof;

wherein the one or more means for attachment are comprised of cable, rope, yarn, thread, wire, twine, line, cord, nylon, monofilament, or any combination thereof; and wherein the one or more means for attachment connect a first frame to a second frame or a first frame and a third frame to a second frame and a fourth frame.

6. A gaming assembly comprising two or more frames, two or more facings, and one or more means for attachment, wherein the one or more means for attachment comprises a piece of rope comprising a first end and a second end, wherein the first and second end each comprise a piece of magnetic metal attached thereto, wherein the magnetic metal attached to the first end is captured by one or more magnetic strips on a facing attached to the first frame and the magnetic metal attached to the second end is captured by one or more magnetic strips on a facing attached to the second frame; wherein the piece of magnetic metal attached to the first end of the rope is permanently affixed, and wherein the piece of magnetic metal attached to the second end of the rope is adjustably connected to the rope by means of an adjustable anchor, wherein the adjustable anchor allows one to change the length of the rope and the distance between the two frames; and wherein the one or more means of attachment are two, three, four, five, six, seven, eight, nine, ten, eleven, twelve, thirteen, fourteen, fifteen, sixteen, seventeen, eighteen, nineteen, twenty or more means for attachment;

wherein the adjustable anchor is a line cleat comprising a base, a first lip, a second lip, and a notch; wherein the rope wraps around the cleat and is anchored in the notch of the cleat, wherein the base comprises a piece of magnetic metal attached on an end opposite the first and second lip; and wherein the line cleat is comprised of metal, plastic, resin, fiberglass, or a combination thereof.

* * * * *